US008337689B2

(12) United States Patent
Yun et al.

(10) Patent No.: US 8,337,689 B2
(45) Date of Patent: Dec. 25, 2012

(54) COMPOSITION FOR PLASMA ELECTROLYTIC OXIDATION (PEO) TREATMENT OF MAGNESIUM ALLOY PRODUCTS

(75) Inventors: Gi Yeol Yun, Gumi (KR); Jae In You, Daegu (KR); Jae Yong You, Daegu (KR); Jae Gon Yun, Daegu (KR); Jin Hie Kim, Gyeongsan (KR); Chang Hun Park, Daegu (KR); Duck Hee Kim, Gyeongsan (KR); Mi Kyeong Lee, Daegu (KR)

(73) Assignee: Wiscohitec Co., Ltd., Gimcheon, Gyeongsangbuk-do (KR)

( * ) Notice: Subject to any disclaimer, the term of this patent is extended or adjusted under 35 U.S.C. 154(b) by 364 days.

(21) Appl. No.: 12/855,816

(22) Filed: Aug. 13, 2010

(65) Prior Publication Data

US 2011/0048965 A1 Mar. 3, 2011

(30) Foreign Application Priority Data

Aug. 25, 2009 (KR) ..... 10-2009-0078856

(51) Int. Cl.
*C25D 11/30* (2006.01)

(52) U.S. Cl. ..... 205/321; 205/106

(58) Field of Classification Search ..... 205/321
See application file for complete search history.

(56) References Cited

U.S. PATENT DOCUMENTS

| | | | | |
|---|---|---|---|---|
| 4,668,347 | A * | 5/1987 | Habermann et al. | 205/50 |
| 5,720,866 | A * | 2/1998 | Erokhine et al. | 205/83 |
| 2003/0079994 | A1* | 5/2003 | Dolan | 205/102 |
| 2004/0040854 | A1* | 3/2004 | Naganuma | 205/109 |

FOREIGN PATENT DOCUMENTS

| | | |
|---|---|---|
| JP | 2007-308757 | 11/2007 |
| JP | 2009-185331 | 8/2009 |
| KR | 1020040094105 | 11/2004 |
| KR | 1020050103647 | 11/2005 |

* cited by examiner

*Primary Examiner* — Patrick Ryan
*Assistant Examiner* — William Leader
(74) *Attorney, Agent, or Firm* — Lowe Hauptman Ham & Berner, LLP

(57) ABSTRACT

Disclosed herein is a composition for plasma electrolytic oxidation (PEO) treatment of magnesium alloy products, which contains a sodium hydroxide (NaOH) solution as a main component, the composition comprising, based on the weight of sodium hydroxide contained in the sodium hydroxide solution: 1-20 wt % of sodium fluoride (NaF); 1-15 wt % of trisodium phosphate ($Na_3PO_4$); 1-10 wt % of sodium pyrophosphate ($Na_4P_2O_7$); 1-20 wt % of aluminum hydroxide ($Al(OH)_3$); 1-20 wt % of sodium fluorosilicate ($Na_2SiF_6$); 1-10 wt % of potassium hydroxide (KOH); 1-15 wt % of potassium acetate ($C_2H_3O_2K$); and 1-10 wt % of rare earth metal powder. The disclosed composition can form a firm, dense and uniform oxide film on the surface of a magnesium alloy product.

1 Claim, 4 Drawing Sheets

COMPOSITION FOR PLASMA ELECTROLYTIC OXIDATION (PEO) TREATMENT OF MAGNESIUM ALLOY PRODUCTS

BACKGROUND OF THE INVENTION

1. Field of the Invention

The present invention relates to a composition for plasma electrolytic oxidation (PEO) treatment of magnesium alloy products, which is used as an electrolyte in a PEO surface treatment process. More specifically, the present invention relates to a low alkaline solution composition for PEO treatment of magnesium alloy products, which can form a firm, dense and uniform oxide film on the surface of the magnesium alloy products.

2. Description of the Prior Art

In general, magnesium alloys have excellent dimensional stability, specific strength, electromagnetic wave shielding properties and vibration-damping properties compared to aluminum alloys and steel, and thus are frequently used for automotive and aircraft parts, mobile phone cases, notebook computer cases, spectacles frames, etc. However, because these magnesium alloys have low standard electrode potential and poor corrosion resistance, they are surface-treated to prevent corrosion.

Methods for treating the surface of products made of magnesium alloys include anodizing treatment and plasma electrolytic oxidation (PEO) treatment.

Because magnesium alloys are easily oxidized, they necessarily require a surface treatment process that is a pretreatment process. In the surface treatment process, products made of magnesium alloys are treated by plasma electrolytic oxidation to form an MgO thin layer on the surface thereof.

Specifically, a sodium hydroxide (NaOH) solution is mainly used as an electrolyte in existing plasma electrolytic oxidation systems. A hydroxyl group (OH—) in the sodium hydroxide solution is bound to the surface layer of magnesium alloy products to form an oxide film. A strong electric field which is formed in the formed oxide film generates plasma which instantaneously forms an oxide, thus forming MgO and $Mg(OH)_2$ thin layers on the surface layer of the magnesium alloy products.

However, in the prior art, there is a limitation in improving the color and uniformity of magnesium alloy products, because a sodium hydroxide (NaOH) solution is used as an electrolyte in PEO surface treatment systems.

SUMMARY OF THE INVENTION

Accordingly, the present invention has been made in view of the problems occurring in the prior art, and it is an object of the present invention to provide a low alkaline solution composition for plasma electrolytic oxidation (PEO) treatment of magnesium alloy products, which comprises, in addition to a sodium hydroxide solution as an electrolyte, materials influencing film firmness, denseness, porosity and roughness, and thus can form a firm, dense and uniform oxide film on the surface of the magnesium alloy products.

To achieve the above object, the present invention provides a composition for plasma electrolytic oxidation (PEO) treatment of magnesium alloy products, which contains a sodium hydroxide (NaOH) solution as a main component, the composition comprising, based on the weight of sodium hydroxide contained in the sodium hydroxide solution: 1-20 wt % of sodium fluoride (NaF); 1-15 wt % of trisodium phosphate ($Na_3PO_4$); 1-10 wt % of sodium pyrophosphate ($Na_4P_2O_7$); 1-20 wt % of aluminum hydroxide ($Al(OH)_3$); 1-20 wt % of sodium fluorosilicate ($Na_2SiF_6$); 1-10 wt % of potassium hydroxide (KOH); 1-15 wt % of potassium acetate ($C_2H_3O_2K$); and 1-10 wt % of rare earth metal powder.

BRIEF DESCRIPTION OF THE DRAWINGS

The above and other objects, features and advantages of the present invention will be more clearly understood from the following detailed description taken in conjunction with the accompanying drawing, in which.

DETAILED DESCRIPTION OF THE INVENTION

Figure 1:
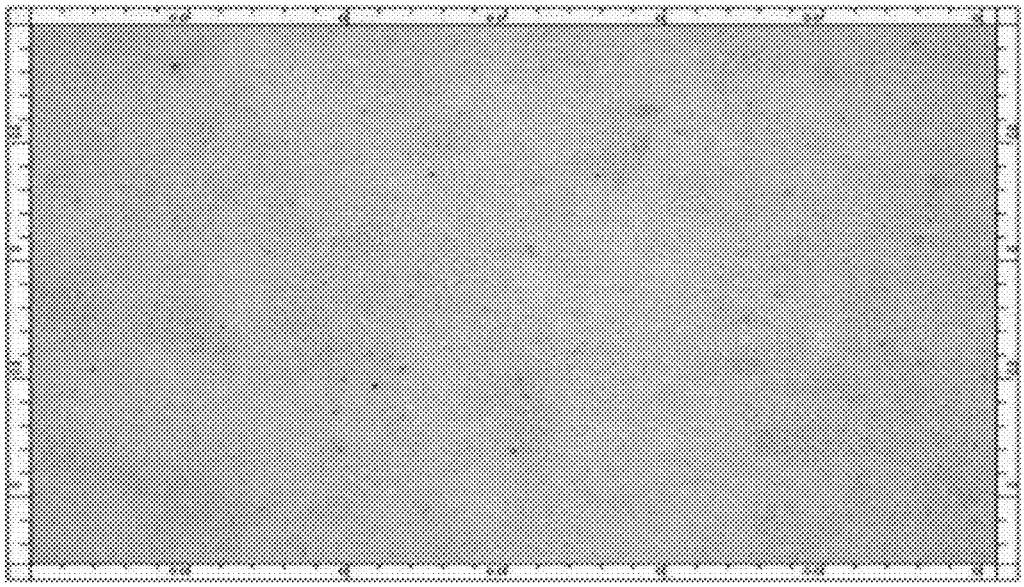
FIG. 1 is an enlarged photograph of the surface of a magnesium alloy product treated with a composition for PEO treatment according to the present invention.

Hereinafter, preferred embodiments of a composition for PEO treatment of magnesium alloy products according to the present invention will be described in further detail.

The present invention relates to an electrolyte composition for PEO treatment of magnesium alloy products, which contains a sodium hydroxide (NaOH) solution as a main component.

The composition for PEO treatment according to the present invention comprises, in addition to the sodium hydroxide solution, sodium fluoride (NaF), trisodium phosphate ($Na_3PO_4$), sodium pyrophosphate ($Na_4P_2O_7$), aluminum hydroxide ($Al(OH)_3$), sodium fluorosilicate ($Na_2SiF_6$), potassium hydroxide (KOH), potassium acetate ($C_2H_3O_2K$), and rare earth metal powder.

In particular, the composition for PEO treatment according to the present invention comprises, based on the weight of sodium hydroxide contained in the sodium hydroxide solution: 1-20 wt % of sodium fluoride (NaF); 1-15 wt % of trisodium phosphate ($Na_3PO_4$); 1-10 wt % of sodium pyrophosphate ($Na_4P_2O_7$); 1-20 wt % of aluminum hydroxide ($Al(OH)_3$); 1-20 wt % of sodium fluorosilicate ($Na_2SiF_6$); 1-10 wt % of potassium hydroxide (KOH); 1-15 wt % of potassium acetate ($C_2H_3O_2K$); and 1-10 wt % of rare earth metal powder.

For reference, sodium hydroxide is prepared by the caustification of sodium carbonate and the electrolysis of sodium chloride. It has strong deliquescence and is a colorless transparent crystal when it is pure. However, it usually contains impurities, and thus is a slightly opaque white solid. It remains in the orthorhombic alpha-phase (low-temperature phase) at room temperature and exists in the cubic beta-phase (high-temperature phase) at 299.6° C.

Sodium hydroxide has a melting point of 328° C. when it is completely dehydrated, but indeed it has a melting point of 318.4° C., because it contains small amounts of water and carbonate which are difficult to remove. In addition, it has a boiling point of 1390° C., a specific gravity of 2.130, a refractive index of 1.3576, a heat of fusion of 1.70 kcal/mol, and a heat of formation of 102.7 kcal/mol. 1-, 2-, 3-, 3.5-, 4-, 5- and 7-hydrates of sodium hydroxide are known, and a 3.5-hydrate of sodium hydroxide is a colorless monoclinic crystal and has a melting point of 15.5° C.

It easily dissolves in water and generates a large amount of heat when it is dissolved. An aqueous solution of sodium hydroxide is strongly basic in nature, and the solubility of sodium hydroxide in 100 g of water is 42 g at 0° C., 109 g at 20° C., and 347 g at 100° C. It is easily soluble in ethyl alcohol and glycerol, but is insoluble in ether, acetone and liquid ammonia.

It has deliquescence, and thus when it is allowed to stand in air, it absorbs moisture and carbon dioxide to produce sodium carbonate. The produced sodium carbonate is difficult to dissolve in a concentrated sodium hydroxide solution, and the use of this property makes it possible to prepare an aqueous sodium hydroxide solution containing no carbonate.

Furthermore, when a sodium hydroxide solution is dissolved together with poorly soluble silicate, phosphate or sulfate, a water-soluble sodium salt is produced. In addition, sodium hydroxide reacts with fluorine at low temperature to produce sodium fluoride, water and oxygen, and it reacts with chlorine, bromine, iodine and the like to produce various oxyhalides at low temperature and sodium halides at high temperature.

Moreover, sodium hydroxide reacts with phosphorus to produce sodium phosphates and phosphine and phosphoryl compounds, and it reacts with arsenic to produce sodium arsenite and arsine. When sodium hydroxide is heated with calcium, it is reduced to sodium. Also, a concentrated aqueous solution of sodium hydroxide reacts with silicon to produce sodium silicate and hydrogen, and precipitates hydroxides in most aqueous metal salt solutions.

In the present invention, sodium fluoride (NaF) is used to ensure film firmness and denseness. If sodium fluoride is added in an amount of more than 20 wt % based on the weight of sodium hydroxide contained in the sodium hydroxide solution, it can reduce film denseness to adversely affect the roughness of an oxide film which is formed on the surface of a magnesium alloy product. If sodium fluoride is added in an amount of less than 1 wt % based on the weight of sodium hydroxide contained in the sodium hydroxide solution, it cannot ensure film firmness and denseness, because the amount thereof added is too small compared to the amounts of other components in the PEO composition.

For reference, sodium fluoride is a colorless cubic crystal or white crystalline powder and easily dissolves in water, but does not easily dissolve in alcohol. An aqueous solution of sodium fluoride is corrosive and has a small size of fluorine ions ($F^-$), and thus bonds with cations to form a stable complex. Fluorine is used to make a polymer coating called Teflon and is easily substituted with a hydroxyl group.

In the present invention, trisodium phosphate ($Na_3PO_4$) influences film roughness. If trisodium phosphate is added in an amount of more than 15 wt % based on the weight of sodium hydroxide contained in the sodium hydroxide solution, it can adversely affect the roughness of an oxide film which is formed on the surface of a magnesium alloy product, and if it is added in an amount of less than 1 wt % based on the weight of sodium hydroxide contained in the sodium hydroxide solution, it cannot influence the film roughness, because the amount thereof added is small compared to the amounts of other components in the PEO composition.

For reference, with respect to the preparation of trisodium phosphate, an anhydrous trisodium phosphate is obtained by adding an equivalent of sodium hydroxide to an aqueous solution of disodium hydrogen phosphate, evaporating and drying the mixture, and then heating and dehydrating the dried material in an electric furnace. Also, a 12-hydrate of trisodium phosphate is obtained at room temperature by adding an excess of sodium hydroxide to phosphoric acid and evaporating and concentrating the mixture.

Moreover, 10-, 6- and 0.5-hydrates of trisodium phosphate are also obtained depending on crystallization temperature. Anhydrous trisodium phosphate is colorless powder and has a melting point of 1340° C. and a density of 2.536 g/cm$^3$ (17° C.), and the solubility thereof in 100 g of water is 4.5 g at 0° C. and 77 g at 100° C. A 12-hydrate of trisodium phosphate has a melting point of 73.4° C. and a specific gravity of 1.62 and is a hexagonal crystal, and the solubility thereof in water is 28.32 g/100 g (15° C.). It is dehydrated at 100° C. to produce a mono-hydrate and is used as an alkaline cleaner, a tanning agent, a pipe cleaner, a water softener and the like.

In the present invention, sodium pyrophosphate ($Na_4P_2O_7$) influences film porosity. If sodium pyrophosphate is added in an amount of more than 10 wt % based on the weight of sodium hydroxide contained in the sodium hydroxide solution, it can increase the number of pores per unit area to adversely affect the surface uniformity of an oxide film which is formed on the surface of a magnesium alloy product, and if it is added in an amount of less than 1 wt %, it cannot influence film porosity, because the amount thereof added is too small compared to the amounts of other components in the PEO composition.

For reference, sodium pyrophosphate ($Na_4P_2O_7$) includes a crystal (decahydrate) and an anhydride, which are termed "sodium pyrophosphate (crystal) " and "sodium pyrophosphate (anhydride), respectively. It is dissolved in water to produce $Na_4P_2O_7.nH_2O$. It is easily soluble in water, but insoluble in alcohol. It has a strong ability to form soluble complex salts with metal ions, and thus has a great ability to sequester metal ions. It can be weathered and is changed into $Na_2HPO_4$ when it is boiled in the presence of an inorganic acid.

In the present invention, aluminum hydroxide ($Al(OH)_3$) influences film porosity. If aluminum hydroxide is added in an amount of more than 20 wt % based on the weight of sodium hydroxide contained in the sodium hydroxide solution, it can increase the number of pores per unit area to adversely affect the surface uniformity of a film which is formed on the surface of a magnesium alloy product, and if it is added in an amount of less than 1 wt %, it cannot influence film porosity, because the amount thereof added is too small compared to the amounts of other components in the PEO composition.

For reference, aluminum hydroxide ($Al(OH)_3$) exists as gibbsite and diaspore in nature and is produced as a white colloidal precipitate when ammonia water is added to an aqueous solution of an aluminum salt. Upon heating, it loses one molecule of water at 300° C. It is an amphoteric hydroxide, which reacts with alkali to form aluminate and reacts with acid to form a salt thereof.

Also, aluminum hydroxide is gelled when it is brought into contact with water for a long time. It is used as an adsorbing agent, an ion exchanger material, a packing agent for chromatography, an extender for paper, or a raw material for preparing aluminum oxide. In addition, when it is filled into a fiber, the waterproof properties of the fiber are increased, and thus it is used as an additive for preparing waterproof cloth.

In the present invention, sodium fluorosilicate ($Na_2SiF_6$) influences film roughness. If sodium fluorosilicate is added in an amount of more than 20 wt % based on the weight of sodium hydroxide contained in the sodium hydroxide solution, it can adversely affect the roughness of an oxide film which is formed on the surface of a magnesium alloy product, and if it is added in less than 1 wt %, it cannot influence film roughness, because the amount thereof added is too small compared to the amounts of other components in the PEO composition.

For reference, sodium fluorosilicate ($Na_2SiF_6$) is one of various salts obtained by treating fluorosilicic acid and is most frequently used for the fluorination of tap water. It is obtained as a by-product in a phosphate fertilizer production process.

When gas produced as a by-product when ground phosphate ore is treated with sulfuric acid reacts with water, fluorosilicic acid is obtained, and when the fluorosilicic acid is neutralized with sodium carbonate, sodium fluorosilicate is obtained as a precipitate. Sodium fluorosilicate is a white, odorless crystalline powder, and the solubility is 0.44% at 0° C. and 2.45% at 100° C. It is industrially used as a laundry neutralizing agent and for the manufacture of opal glass and the mothproof finishing of woolen fabrics.

In the present invention, potassium hydroxide (KOH) influences film color and uniformity. If potassium hydroxide is added in an amount of more than 10 wt % based on the weight of sodium hydroxide contained in the sodium hydroxide solution, it will increase the density of brown color in the color of an oxide film which is formed on the surface of a magnesium alloy product, thus adversely affecting the uniformity of the ivory surface of the oxide film. If it is added in an amount of less than 1 wt %, it cannot influence the color and uniformity of the film, because the amount thereof added is too small compared to the amounts of other components in the PEO composition.

For reference, potassium hydroxide is obtained by the electrolysis of an aqueous potassium chloride solution, and when it is allowed to stand in air, it dissolves by absorbing moisture due to its deliquescence. Also, it absorbs carbon dioxide to produce potassium carbonate and generates heat when it is dissolved in water. An aqueous solution of potassium hydroxide is strongly basic.

Potassium hydroxide has chemical properties very similar to sodium hydroxide and is used for the preparation of various potassium compounds, potassium glass, soft soap, dyes (indigo, etc.), synthetic fiber raw materials (terephthalic acid, etc.) and the like. In addition, it is also used in alkaline battery cells, analytical reagents, carbon dioxide absorbing agents, etc.

In the present invention, potassium acetate ($C_2H_3O_2K$) influences the pore size of an oxide film which is formed on the surface of a magnesium alloy product. If it is added in an amount of more than 15 wt % based on the weight of sodium hydroxide contained in the sodium hydroxide solution, it can increase the pore size of the film to adversely affect the uniformity and roughness of the film, and if it is added in an amount of less than 1 wt %, it cannot influence the film pore size, because the amount thereof added is too small compared to the amounts of other components in the PEO composition.

For reference, potassium acetate ($C_2H_3O_2K$) easily dissolves in ethanol, but does not easily dissolve in ether. It is a colorless deliquescent crystal which is used as analytical reagents and organic synthetic raw materials. It is colorless to white in appearance and is easily soluble. Also, it is crystalline or glossy powder.

In the present invention, rare earth metal powder can influence the shape and ivory color of an oxide film, when a portion of the powder dissolves in solution while being ionized. If the rare earth metal powder is added in an amount of more than 10 wt % based on the weight of sodium hydroxide contained in the sodium hydroxide solution, the amount of non-ionized metal powder can be increased to increase the amount of unnecessary impurities, and if it is added in an amount of less than 1 wt %, it cannot influence the shape and ivory color of the oxide film, because the amount thereof added is too small compared to the amounts of other components in the PEO composition.

For reference, the term "rare earth metals" refers to the elements scandium, yttrium, and lanthanum. These metals have oxidation numbers of +2, +3 and +4 and usually form trivalent (+3) compounds. Also, they form tetravalent (+4) compounds in cerium, terbium and praseodymium, and divalent (+2) compounds in ytterbium, europium and samarium. These metals mostly have silver-gray gloss, and the electropositivity thereof is strong, next to those of alkali metals and alkaline earth metals. Thus, aqueous solutions of these metals are basic in nature.

As described above, the present invention is a composition for PEO treatment of magnesium alloys which contains a sodium hydroxide (NaOH) solution as a main component. In the composition according to the present invention, based on the weight of sodium hydroxide contained in the sodium hydroxide solution, the above-specified amounts of sodium fluoride (NaF), trisodium phosphate ($Na_3PO_4$), sodium pyrophosphate ($Na_4P_2O_7$), aluminum hydroxide ($Al(OH)_3$), sodium fluorosilicate ($Na_2SiF_6$), potassium hydroxide (KOH), potassium acetate ($C_2H_3O_2K$) and rare earth metal powder are added to and mixed with the sodium hydroxide solution. When the composition for PEO treatment is used, an oxide film having a color close to ivory can be formed on the surface of a magnesium alloy product by the interaction of the materials of the composition.

Figure 2:
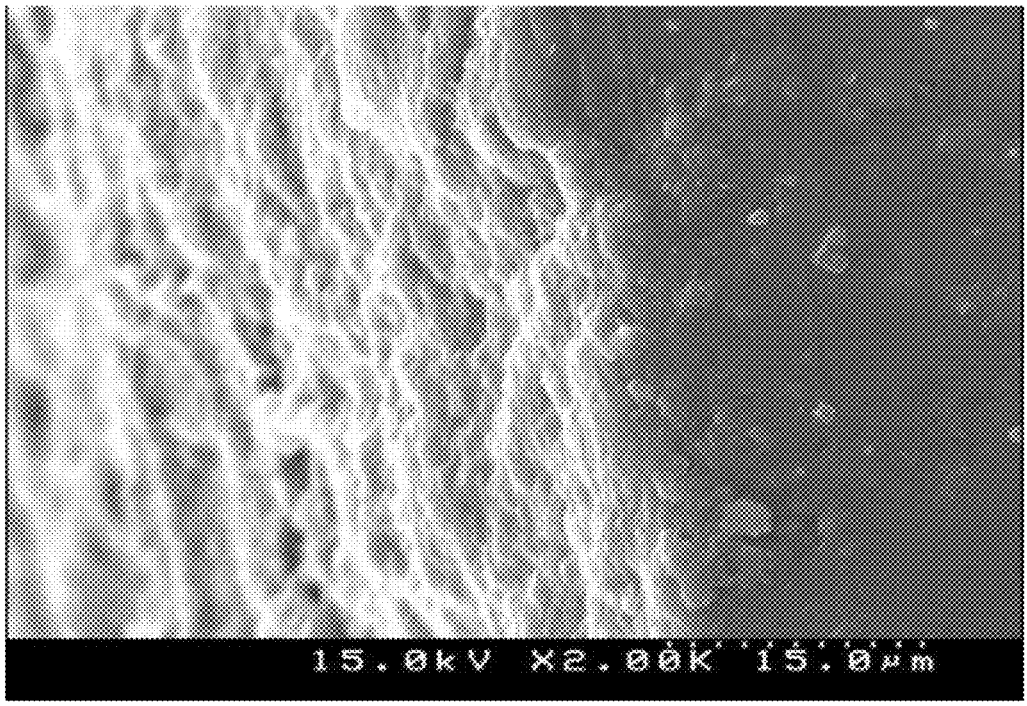
FIG. 2 is an enlarged DATA-SEM (scanning electron microscope) photograph of the surface of a magnesium alloy product treated with a composition for PEO treatment according to the present invention.
Figure 3:
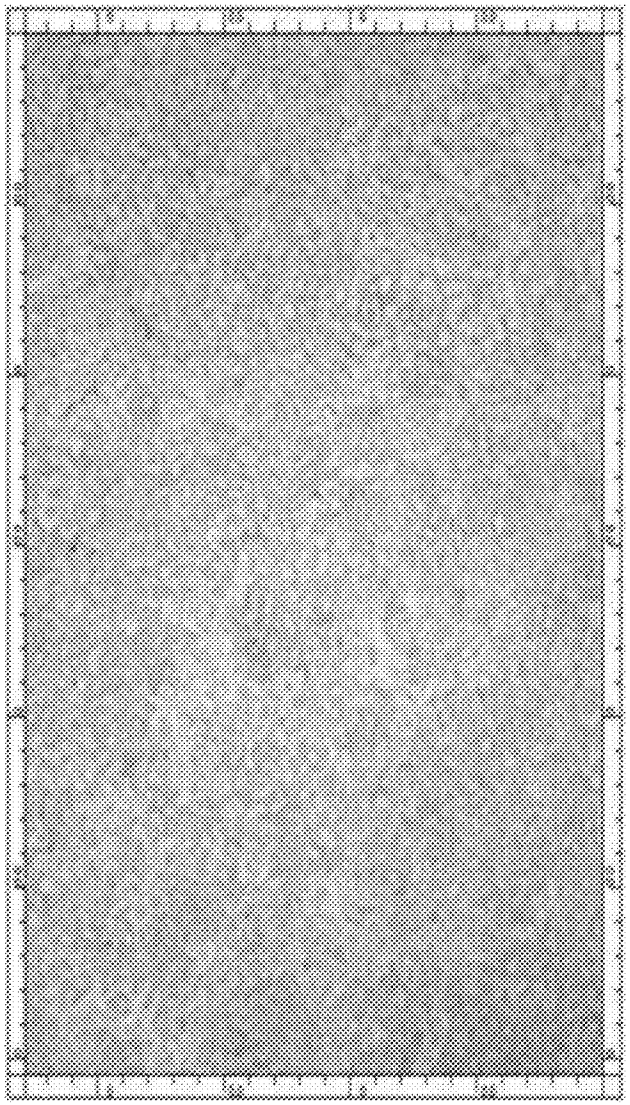
FIGS. 3 and 4 are enlarged photographs of the surfaces of magnesium alloy products treated with surface treatment solutions according to the prior art.
Figure 4:
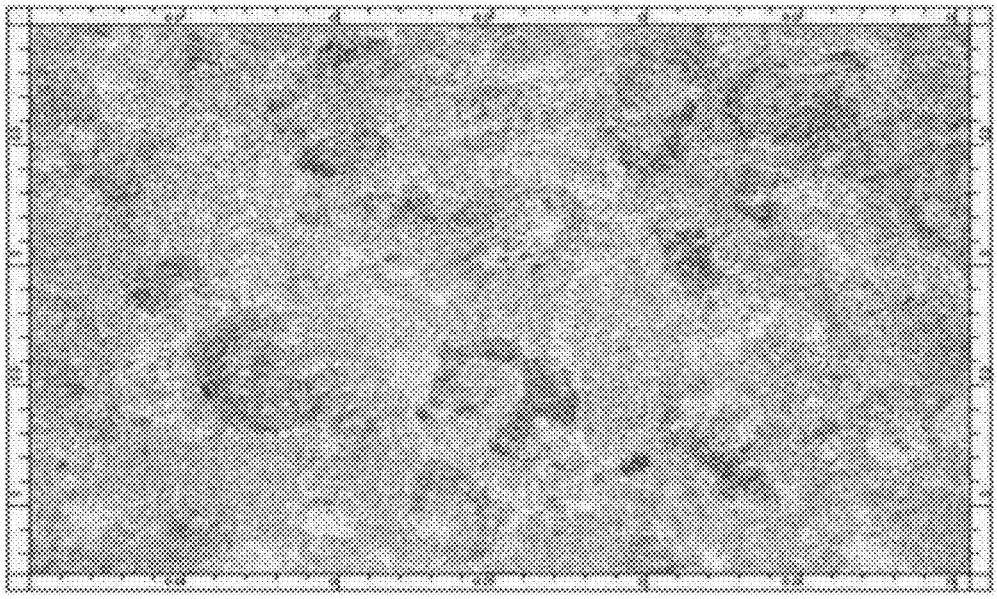

In an experiment, the composition for PEO treatment according to the present invention was used to treat the surface of a magnesium alloy product, and the treated surface was observed. The observation results are shown in FIGS. 1 and 2. As can be seen therein, a firmer, denser and smoother oxide film compared to those shown in FIGS. 3 and 4, obtained using surface treatment solutions according to the prior art, could be formed on the surface of the magnesium alloy product.

As described above, the composition for PEO treatment according to the present invention, when used for PEO treatment, ensures film firmness and denseness by sodium fluoride (NaF), ensures film firmness and denseness by trisodium phosphate ($Na_3PO_4$) and sodium fluorosilicate ($Na_2SiF_6$), ensures film porosity by sodium pyrophosphate ($Na_4P_2O_7$) and aluminum hydroxide ($Al(OH)_3$), and ensures the film color and uniformity, the film pore size and the film morphology by potassium hydroxide (KOH), potassium acetate ($C_2H_3O_2K$) and rare earth metal powder. Accordingly, the use of the composition according to the present invention can form a firm, dense and uniform oxide film on the surface of a magnesium alloy product.

Although the preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A composition for plasma electrolytic oxidation (PEO) treatment of magnesium alloy products, which contains a sodium hydroxide (NaOH) solution as a main component, the composition comprising, based on the weight of sodium hydroxide contained in the sodium hydroxide solution: 1-20 wt % of sodium fluoride (NaF); 1-15 wt % of trisodium phosphate ($Na_3PO_4$); 1-10 wt % of sodium pyrophosphate ($Na_4P_2O_7$); 1-20 wt % of aluminum hydroxide ($Al(OH)_3$); 1-20 wt % of sodium fluorosilicate ($Na_2SiF_6$); 1-10 wt % of potassium hydroxide (KOH); 1-15 wt % of potassium acetate ($C_2H_3O_2K$); and 1-10 wt % of rare earth metal powder.

* * * * *